United States Patent [19]

Medynski

[11] 4,381,022

[45] Apr. 26, 1983

[54] HOLY WATER FONT

[76] Inventor: Joseph M. Medynski, 183 E. Main St., Ramsey, N.J. 07446

[21] Appl. No.: 329,393

[22] Filed: Dec. 10, 1981

[51] Int. Cl.[3] ..... B65B 3/04

[52] U.S. Cl. ..... 141/86; 141/351; 4/DIG. 3

[58] Field of Search ..... 141/351, 97, 140–143, 141/156–162, 352–362, 392, 86, 87, 88; 4/DIG. 3; 222/108, 109, 110

[56] References Cited

U.S. PATENT DOCUMENTS 3,033,248 5/1962 Ritchie ..... 141/351

3,151,340 10/1964 Teshima ..... 4/DIG. 3

*Primary Examiner*—Houston S. Bell, Jr.

*Attorney, Agent, or Firm*—W. Patrick Quast

[57] ABSTRACT

An improved holy water font comprising a stand including an upright, hollow member having an opening to allow the user to place his hand therein. Disposed on either side of the opening is a photoelectric detection system containing an exciter and receiver. This generates a light path across a part of the volume accessible through the opening. Water dispensing apparatus is positioned above the opening, which responds to a control electrical signal. The latter is generated when the light path between the exciter and receiver is interrupted by the user's hand. The photoelectric exciter and receiver is disposed either vertically on either side of the opening. When disposed vertically, a transparent protective shield is employed to protect the lens of the exciter or receiver, whichever is disposed below the opening. The font includes a covered water reservoir disposed at the top of the stand, and a drainable collecting basin disposed below the opening, in the hollow upright member.

4 Claims, 4 Drawing Figures

FIG. 1
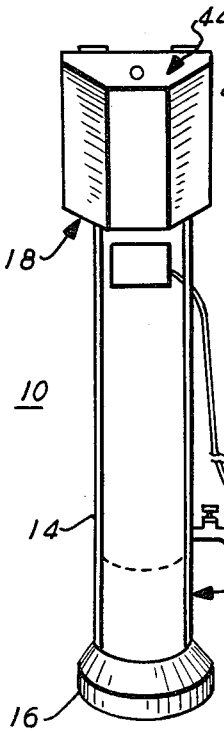
FIG. 2
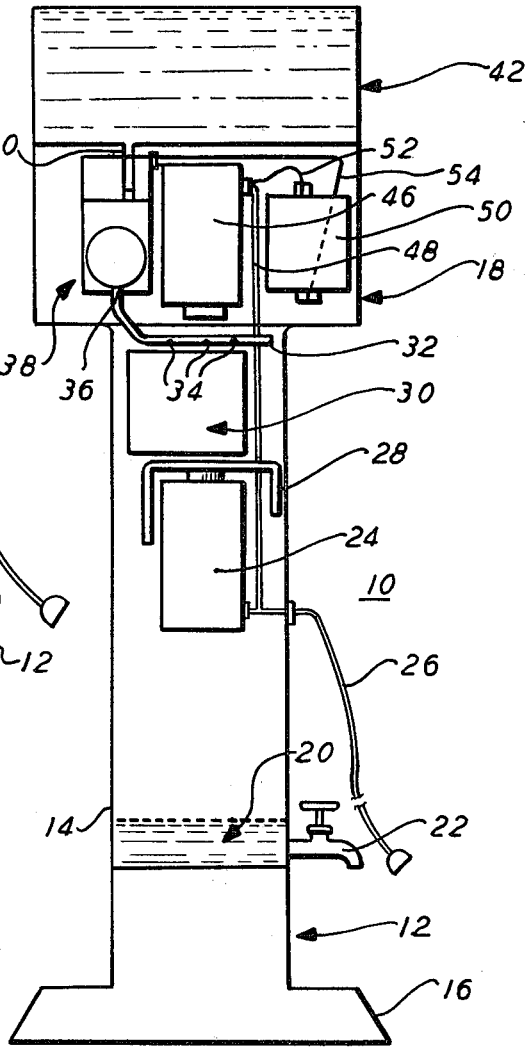
FIG. 3
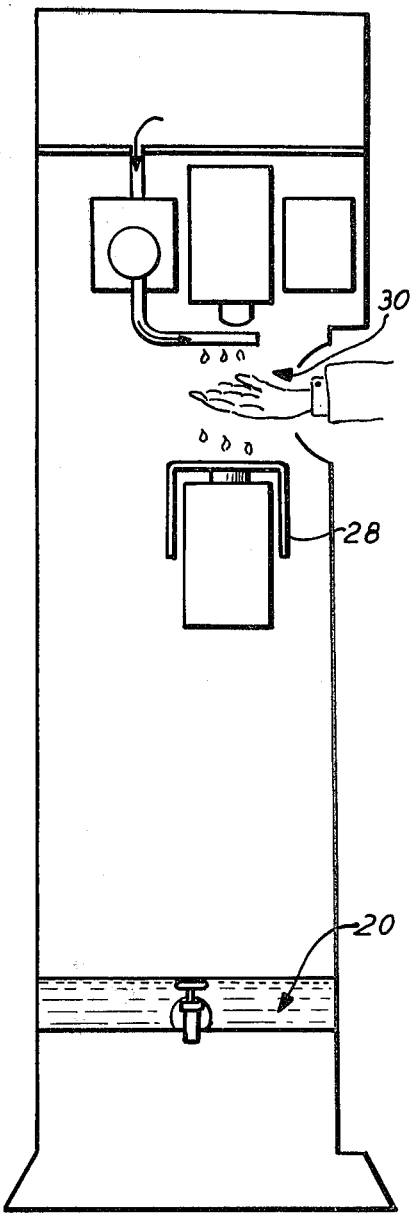
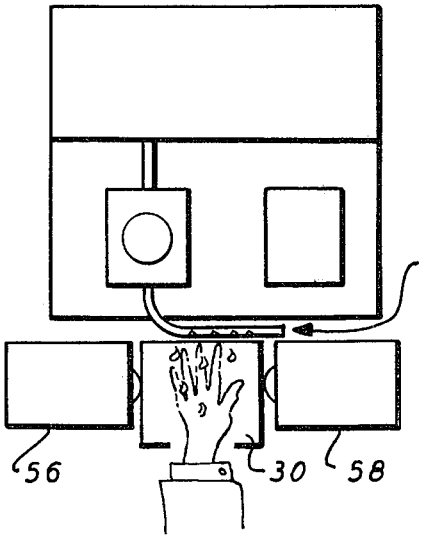
FIG. 4

HOLY WATER FONT

BACKGROUND OF THE INVENTION

1. Field of the Invention

This invention pertains generally to holy water fonts, and more particularly, to an hygienic font employing electrically controlled means to dispense the holy water as needed.

2. Description of the Prior Art

Positioned at each of the entrance ways to Roman Catholic Churches are holy water fonts. Traditionally, these are basins of blessed water into which church-going members place fingers for the subsequent purpose of blessing themselves with the sign of the cross. Obviously, hygienic problems result as well as the merkiness of the water due to collected dirt and dust.

Therefore, it is a primary object of this invention to provide improved holy water fonts which obviate the hygienic problems previously attributed to such fonts.

It is another object of this invention to provide a font which stores the water in such a manner as to preclude its contamination by dirt, dust, etc.

SUMMARY OF THE INVENTION

Towards the accomplishment of these and other objectives and advantages which will become more apparent from a reading of the description and observation of the drawings, there is described an improved holy water font comprising a stand which includes an upright, hollow member having an opening permitting the user to place his hand therein. Photoelectric exciter and receiving means are disposed, either vertically or horizontally, on either side of the opening. These create a light path across a part of the volume accessible through the opening. Water dispensing means, positioned above the opening, respond to a control electrical signal generated by the interruption of the light path by the hand of the user. A covered reservoir disposed at the top of the stand supplies the dispensing means with water; and a drainable, collecting basin disposed below the opening in said upright, hollow member collects the excess water.

BRIEF DESCRIPTION OF THE DRAWINGS

The above objectives and advantages can perhaps be better appreciated by the following description taken together with the drawings. The latter include:

FIG. 1 is a perspective view of the proposed font;

FIG. 2 is an elevation view with a part of the enveloping housing removed to disclose the internal mechanism comprising the invention.

FIG. 3 is a side elevation view of FIG. 2 showing the present invention in use;

FIG. 4 is a schematic view of a portion of the invention showing a different orientation of the detection system.

DESCRIPTION OF THE PREFERRED EMBODIMENT

Referring now to FIG. 1, there is shown the holy water font 10 of the present invention. It includes a stand 12 comprising a hollow, upright member 14 which is supported by a pedestal mount 16. Positioned on the top of the upright member is a component housing 18.

The hollow upright member 12 is securely positioned in the pedestal 16. The upright member includes a water overflow catch basin 20 which can be drained via faucet 22 or other type of drain cock. Positioned above the basin is one half of a detection mechanism, 24. For purposes of discussion, this is identified as a photoelectric system which responds to the interruption of the light path between the exciter unit and receiving unit 24. Although for purposes of this discussion, unit 24 will be referred to as the receiving unit, it is of no consequence as to which unit is disposed at this point in member 12. The receiving unit is secured to the side wall of the upright member using any suitable means (not shown).

The system including unit 24 is powered by 110 volts or 220 volts which is supplied to the system via electrical cord 26. A battery operated system could likewise be employed.

Positioned above the receiving unit and covering the lens portion thereof, is a transparent, protective shield 28. This, likewise, can be secured to the side wall by suitable means, not shown, or even to the unit 24. The protective shield can be fashioned from clear glass or plastic or some other transparent material which will allow the photoelectric light to pass between the exciter and receiver, and yet protect the receiver lens from dispensed water. The shield can be positioned at a slight angle off the horizontal in order to allow water to roll off into the catch basin 20.

Above the shield is an opening 30 which allows the user to place his hand in the photoelectric light path. Disposed above the opening and generally out of the path of the light emitting from the photoelectric exciter is a water dispensing pipe 32. It includes a plurality of openings 34 disposed along the under side of the pipe for directing water downward into the volume accessible through the opening 30. The free end of the pipe 32 is suitably closed and the feed end is connected to the output orifice 36 of a water solenoid valve 38.

The input orifice 40 of the latter is connected by suitable piping to a replenishment reservoir 42 which stores the blessed water. Access to this storage basin is provided by hinged cover 44 (see FIG. 1). This cover protects the water from dust and dirt in the environment.

Also positioned above the opening 30 is the exciter unit 46 of the photoelectric system. This is powered by electricity via electric line 48. The latter is connected to line 26 at a suitable junction box, not shown.

Also mounted in the enclosure 18 is a control transformer 50. The primary winding of the transformer is connected via lead 52 to the photoelectric detection system, here shown connected to the exciter unit 46. The secondary winding of the control transformer is connected via line 54 to the valve actuating mechanism of the solenoid 38.

Referring to FIG. 3, when the user places his hand in the opening 30 it interrupts the light path between the exciter and receiver, 46 and 24. The path transverses a portion of the volume within the upright member accessible through the opening.

A control electrical voltage is generated by the photoelectric detection system and applied via line 52 to the control transformer 50. A corresponding voltage is induced in the secondary winding of the transformer 50 which is supplied by line 54 to the valve actuating means of solenoid 38. The solenoid is actuated, releasing water from the basin 42. The solenoid valve transfers the water from the basin to the output orifice and then to the dispensing pipe where it drops on to the hand of the user through openings 34. Any water not contacting the user's hand hits the shield and rolls off into the basin 20. Periodically, accumulated water in the basin is drained via faucet 22.

Referring to FIG. 4, the photoelectric detection system 56-58 is disposed in a horizontal orientation on either side of the opening 30. The relationship of the water dispensing pipe 60 is the same with respect to opening 30 as before. This orientation of the photoelectric detection system obviates the need for a shield such as 28 in FIG. 2. Essentially the operation is the same as disclosed with the embodiment of FIG. 2.

The various components described above include the following:

a typical photoelectric system, such as one manufactured by Archer Manufacturing Company; control transformer, model No. 4X744, manufactured by the Dormayer Manufacturing Company of Chicago, Ill.;

water solenoid valve, model No. 6X742, manufactured by Dayton Manufacturing Company of Chicago, Ill.

The pipe connecting the solenoid valve to the water basin 42 and to the water dispensing pipe, would typically be copper piping having a diameter of $\frac{1}{4}''$ and $\frac{1}{8}''$, respectively.

If desired, a regulator, not shown, can be inserted between the orifice of the solenoid 36 and dispensing pipe in order to further control the amount of water flowing into that pipe.

Other modifications and variations to the disclosed embodiment will now be apparent in view of the above description.

It is understood that the breadth of the invention is not limited by this disclosure, but rather is defined by the appended claims.

What is claimed is:

1. An improved holy water font comprising;

a stand including an upright, hollow member having an opening permitting the user to place his hand therein;

photoelectric exciter and receiving means disposed vertically on respective sides of said opening for generating a light path through a part of the volume accessible through the opening;

water dispensing means, positioned above said opening whereby water is dispensed in response to a control electrical signal;

a transparent protective shield means disposed over the one of said exciter or receiving means disposed below said opening for protecting same from dispensed water; and, means for generating said control electrical signal in response to the interruption of the said light path by the hand of the user, whereby water is dispensed by said water dispensing means onto the hand of the user when said light path is interrupted.

2. The font claimed in claim 1 wherein said shield is disposed at a slight angle off the horizontal whereby water deposited thereon rolls off said shield.

3. The font claimed in claims 1, or 2 wherein said water dispensing means includes a covered water reservoir positioned atop said upright member.

4. The font claimed in claims 1, or 2 wherein said water dispensing means includes a covered water reservoir positioned atop said upright member and wherein said upright, hollow member includes a water collecting basin disposed below said opening; for collecting water dispensed by said water dispensing means; and means for draining said water collecting basin.

* * * * *